US009492860B2

(12) United States Patent
Tanaka et al.

(10) Patent No.: US 9,492,860 B2
(45) Date of Patent: Nov. 15, 2016

(54) TUBE END MOLDING METHOD

(71) Applicant: FUTABA INDUSTRIAL CO., LTD, Okazaki-shi, Aichi (JP)

(72) Inventors: Yoshiki Tanaka, Okazaki (JP); Naotaka Arisawa, Okazaki (JP)

(73) Assignee: FUTABA INDUSTRIAL CO., LTD, Aichi (JP)

( * ) Notice: Subject to any disclaimer, the term of this patent is extended or adjusted under 35 U.S.C. 154(b) by 360 days.

(21) Appl. No.: 13/261,886

(22) PCT Filed: Nov. 14, 2012

(86) PCT No.: PCT/JP2012/079540
§ 371 (c)(1),
(2) Date: May 14, 2014

(87) PCT Pub. No.: WO2013/073588
PCT Pub. Date: May 23, 2013

(65) Prior Publication Data

US 2015/0007629 A1 Jan. 8, 2015

(30) Foreign Application Priority Data

Nov. 14, 2011 (JP) ..... 2011-248871

(51) Int. Cl.
*B21D 41/02* (2006.01)
*B21D 19/10* (2006.01)
*B21D 41/04* (2006.01)

(52) U.S. Cl.
CPC ..... *B21D 41/02* (2013.01); *B21D 19/10* (2013.01); *B21D 41/04* (2013.01)

(58) Field of Classification Search
CPC ..... B21D 19/00; B21D 19/10; B21D 19/12; B21D 19/14; B21D 19/16; B21D 41/02; B21D 41/04; B21D 53/84; B21D 15/02; B21C 37/151; B21C 37/154; B21C 37/16; B21C 37/18
USPC ..... 72/367.01, 370.01, 370.02, 370.03, 72/370.06, 370.07, 370.08, 370.1, 370.13; 413/73
See application file for complete search history.

(56) References Cited

U.S. PATENT DOCUMENTS 1,898,374 A * 2/1933 Kvarnstrom ..... B21D 41/00 29/512
2,288,966 A * 7/1942 Blanchet ..... B65H 75/10 138/109

(Continued)

FOREIGN PATENT DOCUMENTS

FR 1271182 9/1961
JP H 0939591 2/1997

(Continued)

OTHER PUBLICATIONS

Extended European Search Report for Application No. EP 12 85 0301.8 dated Sep. 22, 2015.

(Continued)

*Primary Examiner* — Shelley Self
*Assistant Examiner* — Gregory Swiatocha
(74) *Attorney, Agent, or Firm* — Jenkins, Wilson, Taylor & Hunt, P.A.

(57) ABSTRACT

The present invention provides a tube end molding method comprising: a tube shrinking step for forming a tapered portion and a small diameter tube portion at one end of an original tube; a preparing step for preparing a holding die having an original tube bore and a tube expanding bore; and a tube expanding step including a first step for mounting the original tube at the original tube bore of the holding die, a second step for folding the small diameter tube portion inside the original tube beginning at the tapered portion, and a third step for pressing the folded portion against an inner wall of the tube expanding bore.

5 Claims, 8 Drawing Sheets

(56) References Cited

U.S. PATENT DOCUMENTS

| | | | | | |
|---|---|---|---|---|---|
| 3,266,822 | A * | 8/1966 | Hinderer | B21D 41/025 | 285/110 |
| 3,418,409 | A * | 12/1968 | Hesse | B29C 57/00 | 138/109 |
| 5,415,443 | A * | 5/1995 | Hayashi | B21D 39/06 | 285/222 |
| 7,722,518 | B2 * | 5/2010 | Valls Roca | B31F 1/0038 | 493/152 |
| 2003/0222477 | A1 * | 12/2003 | Yoshida | F16F 7/125 | 296/187.03 |

FOREIGN PATENT DOCUMENTS

| | | | |
|---|---|---|---|
| JP | H1182824 | A * | 3/1999 |
| JP | 2000/061539 | A | 2/2000 |
| JP | 2000061539 | A * | 2/2000 |
| JP | 2002/213241 | A | 7/2002 |
| JP | 2002213241 | A * | 7/2002 |
| JP | 2003/145240 | | 5/2003 |
| JP | 2005-349425 | A | 12/2005 |

OTHER PUBLICATIONS

International Search Report for Application No. PCT/JP2012/079540 dated Feb. 19, 2013.

International Preliminary Report for Application No. PCT/JP2012/079540 dated May 30, 2014.

Chinese Office Action for Application No. 201280055924.0 dated Jan. 23, 2015.

Japanese Office Action for Application No. 2011-248371 dated Nov. 10, 2015.

* cited by examiner

TUBE END MOLDING METHOD

CROSS-REFERENCE TO RELATED APPLICATIONS

This international application claims the benefit of Japanese Patent Application No. 2011-248871 filed Nov. 14, 2011 in the Japan Patent Office, and the entire disclosure of Japanese Patent Application No. 2011-248871 is incorporated herein by reference.

TECHNICAL FIELD

The present invention relates to a method of molding one end of an original tube into double-layered and diameter-expanded structure.

BACKGROUND ART

Conventionally, as described in Patent Document 1, a forming method is known, by which a first tapered portion is formed by contracting a diameter of an original tube so that the tube diameter is gradually decreased in the direction of an opening end of the original tube, a second tapered portion is formed so as to continue to the first tapered portion, the second tapered portion having a diameter gradually decreasing at a rate different from the rate at which the tube diameter of the first tapered portion gradually decreases, and the first tapered portion and the second tapered portion are folded and bent inside the original tube to be formed into double-layered structure. In this case, forming one end of the original tube into double-layered structure allows a portion having the double-layered structure to exhibit increased strength and thickness. Accordingly, even with a relatively thin original tube, it is possible to form threaded holes or the like, to weld or the like, at the portion having the double-layered structure.

PRIOR ART DOCUMENTS

Patent Documents

Patent Document 1: Japanese Patent No. 2909713

SUMMARY OF THE INVENTION

Problems to be Solved by the Invention

However, such conventional method requires forming the first tapered portion and the second tapered portion, thereby complicating a molding work or procedure. Such convention method further requires a step of expanding a portion bent and then overlapped and appressing tube walls to each other after the step of folding and bending the first tapered portion and the second tapered portion inside the original tube, thereby complicating a post-process.

It is desired to provide a tube end molding method by which one end of a tube may be easily molded through a simple step.

Means for Solving the Problems

The present invention in a first aspect includes: a tube shrinking step for molding one end of an original tube, in which a tapered portion having a diameter decreasing toward a tube end and a small diameter tube portion continuing from a small diameter side of the tapered portion to the tube end and having a diameter substantially the same as a diameter of the small diameter side are formed at the one end of the original tube; a preparing step for preparing a holding die including: an original tube bore that holds the original tube; and an tube expanding bore formed to continue to the original tube bore and having an inner diameter greater by a predetermined value than an outer diameter of the original tube; and a tube expanding step including: a first step for mounting the original tube into the original tube bore so that at least a part of the tapered portion is housed in the tube expanding bore; a second step for folding the small diameter tube portion inside the original tube beginning at the tapered portion by depressing the small diameter tube portion in an axial direction with a punch member; and a third step for moving the punch member further in the axial direction after folding the small diameter tube portion, inserting a tube expanding portion of the punch member into an inside a folded portion of the original tube, and pressing the folded portion against an inner wall of the tube expanding bore.

According to the present invention in a second aspect, a positioning portion is formed at a tip end of the punch member and is insertable into the small diameter tube portion. The second step includes a step for positioning the punch member and the small diameter tube portion by inserting the positioning portion into the small diameter tube portion.

According to the present invention in a third aspect, the punch member includes a step portion between the positioning portion and the tube expanding portion. The second step includes a step for depressing the small diameter tube portion in the axial direction by impacting the step portion on the tube end of the small diameter tube portion.

According to the present invention in a fourth aspect, the punch member includes a straight portion having a diameter smaller than the tube expanding portion between the step portion and the tube expanding portion.

According to the present invention of a fifth aspect, an outer diameter of the straight portion is approximately the same as an outer diameter of the small diameter tube portion.

Effects of the Invention

With the tube end molding method of the present invention, the tapered portion and the small diameter tube portion are formed through the tube shrinking step. The small diameter tube portion does not need to be tapered-shaped, thereby making molding easier than ever before. Further, with the tube expanding step, while forming a double-layered structure by folding the small diameter tube portion, the portion of double-layered structure may be expanded. Accordingly, an effect may be yielded, in which molding is achieved through the less number of steps.

By employing the punch member having the positioning portion at its tip end, positioning the original tube and the punch member is ensured and made easy. Further, by employing the punch member having the step portion, it is possible to depress the tube end of the original tube easily while positioning. Still further, by employing the punch member having the straight portion, it is possible to inhibit unnecessary pressure from being applied to the original tube upon molding. As a result, it is possible to inhibit generation of cracks and so on upon molding.

EXPLANATION OF REFERENCE NUMERALS

1 . . . original tube, 1*a* . . . small diameter tube portion, 1*b* . . . tapered portion, 2 . . . tube shrinking die, 4 . . . tube shrinking bore, 6 . . . tapered bore, 8 . . . original tube bore, 20 . . . holding die, 21 . . . punch member, 22 . . . tube expanding bore, 23 . . . original tube bore, 24 . . . positioning portion, 26 . . . straight portion, 27 . . . tapered portion, 28 . . . tube expanding portion, 30 . . . step portion, 31 . . . flange

MODE FOR CARRYING OUT THE INVENTION

Hereinafter, embodiments for carrying out the present invention will be described in detail with reference to the drawings.

First Embodiment

Figure 1A:
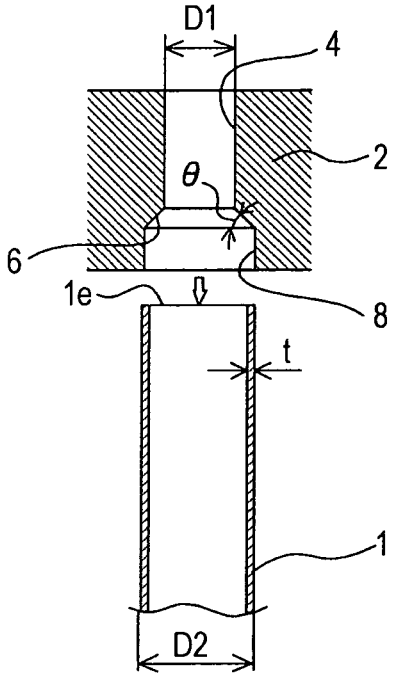
FIGS. 1A to 1B are explanatory views illustrating a tube shrinking step according to a first embodiment of the present invention.
Figure 1B:
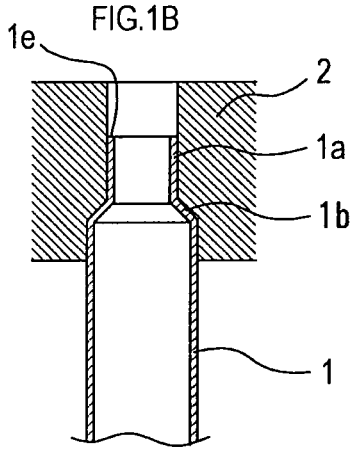

In FIGS. 1A and 1B, an original tube 1 is a pipe (cylindrical tube) of a so-called thin-walled type. According to the first embodiment, the original tube 1 is 0.8 mm in thickness t. The original tube 1 is first molded into an intended shape with a tube shrinking die 2 as described below.

The tube shrinking die 2 includes a tube shrinking bore 4, a tapered bore 6, and an original tube bore 8. The tube shrinking bore 4, the tapered bore 6, and the original tube bore 8 are formed coaxially and continuously. An inner diameter D1 of the tube shrinking bore 4 is smaller than an outer diameter D2 of the original tube 1 (D1<D2). The inner diameter D1 is also slightly smaller than a value obtained by subtracting the quadruple of the thickness t from the outer diameter D2 (D2−4t).

The tapered bore 6 is a tapered bore connecting the tube shrinking bore 4 and the original tube bore 8. It is preferable that a tapered angle θ of the tapered bore 6 (see, FIG. 1A) is approximately 30 to 70 degrees. The angle θ is an angle defined by a horizontal plane and an inner wall of the tapered bore 6 in a state illustrated in FIG. 1A. In other words, the angle θ is an angle defined by a lower end surface of the tube shrinking die 2 and an extended line of the inner wall of the tapered bore 6.

The inner diameter of the original tube bore 8 is formed into a size wherein the original tube 1 is allowed to be inserted thereto. For example, the original tube bore 8 may be formed so that an outer wall of the original tube 1 comes in contact with the inner wall of the original tube bore 8.

A tube shrinking step is described with reference to FIGS. 1A to 1B.

In the tube shrinking step, the original tube 1 is first inserted into the original tube bore 8. The original tube 1 is subsequently pressed into the tube shrinking bore 4 via the tapered bore 6, as illustrated in FIG. 1B. According to this step, a tapered portion 1*b* and a small diameter tube portion 1*a* are formed by the original tube 1 (see FIG. 1B).

The tapered portion 1*b* is a tapered portion formed along the tapered bore 6. Specifically, the tapered portion 1*b* is a portion of which the diameter reduces gradually towards a tube end 1*e* side of the original tube 1.

The small diameter tube portion 1*a* is formed along the tube shrinking bore 4 and continues from a small diameter side of the tapered portion 1*b* to the tube end 1*e* so that the small diameter tube portion 1*a* has a diameter approximately the same as a diameter of the small diameter side of the tapered portion 1*b*. An outer diameter of the small diameter tube portion 1*a* is formed to be smaller than an outer diameter D2 of the original tube 1.

In such tube shrinking step, it is possible to inhibit an increase in the number of steps because the small diameter tube portion 1*a* and the tapered portion 1*b* are formed by a single step by which the original tube 1 is driven into the original tube bore 8, the tapered bore 6, and the tube shrinking bore 4, of the tube shrinking die 2, in series.

According to such tube shrinking step, rippling undulations are not formed at the tube end 1*e* of the original tube 1 (tube end 1*e* of the small diameter tube portion 1*a*). This is because no force is applied, which may form undulations at the tube end 1*e* of the original tube 1 (tube end 1*e* of the small diameter tube portion 1*a*). Therefore, a work or step to flatten the tube end 1*e*, for example by grinding or cutting off the tube end 1*e* of the original tube 1 (tube end 1*e* of the small diameter tube portion 1*a*), is not needed.

Figure 2:
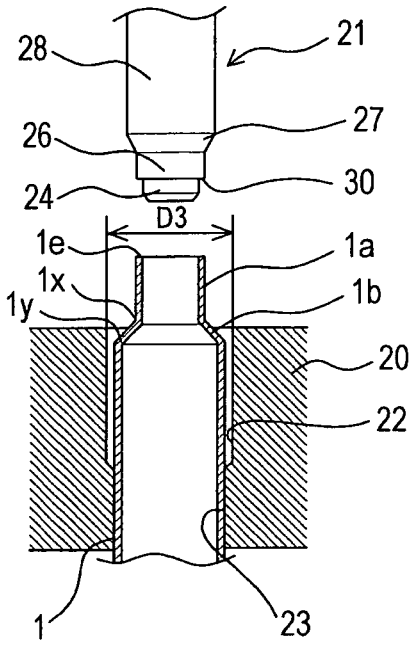
FIG. 2 is an explanatory view illustrating an initial state of a tube expanding step according to the first embodiment of the present invention.

Described next is the tube expanding step with reference to FIGS. 2 to 4. In the tube expanding step, a holding die 20 and a punch member 21 are employed. The holding die 20 includes a tube expanding bore 22 and an original tube bore 23.

An inner diameter D3 of the tube expanding bore 22 is greater than the outer diameter D2 of the original tube 1 (D2<D3). Specifically, according to the first embodiment, the inner diameter D3 may be a value falling between a value obtained by adding twice the thickness t of the original tube 1 into the outer diameter D2 (D2+2t) and a value of, for example, approximately 40% more than the outer diameter D2 (1.4×D2) (D2+2t≤D3≤1.4×D2).

When the inner diameter D3 is smaller than (D2+2t) and when the inner diameter D3 is greater than (1.4×D2), cracks and so on are likely to occur easily during the molding step.

The depth of the tube expanding bore 22 is greater than the axial length of the small diameter tube portion 1*a* and the tapered portion 1*b*, both molded in the tube shrinking step (i.e., combined length of both).

The punch member 21 includes a positioning portion 24, a straight portion 26, a tapered portion 27, and a tube expanding portion 28.

The outer diameter of the positioning portion 24 is formed into a size to be insertable into the small diameter tube portion 1*a*. Specifically, the positioning portion 24 and the small diameter tube portion 1*a* are formed so that the outer wall of the positioning portion 24 tightly comes in contact with the inner wall of the small diameter tube portion 1*a*. As a result, the punch member 21 and the original tube 1 may be positioned when the positioning portion 24 is inserted into the small diameter tube portion 1*a* (relative positions of the punch member 21 and the original tube 1 is determined).

The positioning portion 24 and the straight portion 26 are connected via a step portion 30.

The step portion 30 is formed so as to come in contact with the tube end 1*e* of the original tube 1 when the positioning portion 24 is inserted into the original tube 1.

The outer diameter of the straight portion 26 is formed to be smaller than the outer diameter of the tube expanding portion 28 and to be approximately the same as the outer diameter of the small diameter tube portion 1*a*.

The outer diameter of the tube expanding portion 28 is formed to be as large as a value obtained by subtracting four times the thickness t of the original tube 1 from the inner diameter D3 of the tube expanding bore 22 (D3−4t).

The tapered portion 27 is formed in a tapered shape so as to connect smoothly the straight portion 26 and the tube expanding portion 28.

In the tube expanding step, the original tube 1, formed with the small diameter tube portion 1*a* in the tube shrinking step, is held by the holding die 20.

Specifically, the original tube 1 is held in the original tube bore 23 of the holding die 20 so that a part or entire of the tapered portion 1*b* is housed in the tube expanding bore 22 (preferably, so that the tapered portion 1*b* does not stick out of the tube expanding bore 22). Further, it is preferable that a small diameter end 1*x* of the tapered portion 1*b* is positioned at approximately the same height as the upper end of the holding die 20. This is because it is preferred (or necessary) that, when the original tube 1 is bent at a large diameter end 1*y* and expanded radially outwardly by the tube expanding portion 28 (described below), an expanding function is controlled by the inner wall of the tube expanding bore 22. In order to achieve this control, it is necessary that the tube expanding bore 22 houses a part or entirety (preferably, the entirety) of the tapered portion 1*b*.

In the state where the original tube 1 is held by the holding die 20, the positioning portion 24 of the punch member 21 is inserted into the small diameter tube portion 1*a* until the step portion 30 impacts the tube end 1*e* of the small diameter tube portion 1*a*.

Further, a pressing force along the axial direction is applied to the small diameter tube portion 1*a* by pressing the punch member 21 into the holding die 20.

Figure 3A:
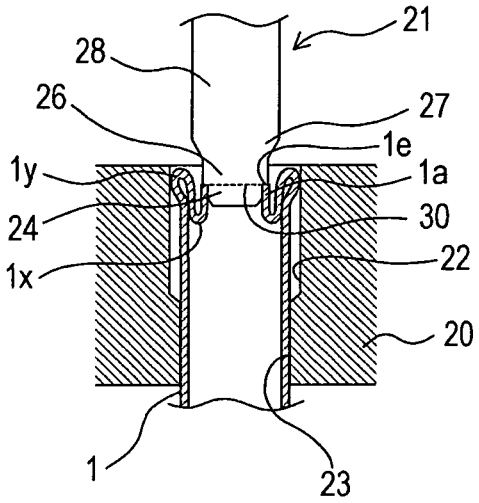
FIGS. 3A to 3B are explanatory views illustrating a folded state in the tube expanding step according to the first embodiment of the present invention.

Accordingly, the original tube 1 is bent to the inside of the original tube 1 at the tapered portion 1*b*, as illustrated in FIG. 3A. That is, the small diameter tube portion 1*a* enters inside the original tube 1. Here, the large diameter end 1*y* of the tapered portion 1*b* is bent into a U-shape so that the inner walls of the original tube 1 face each other. The small diameter end 1*x* of the tapered portion 1*b* is bent into a U-shape so that the outer walls of the original tube 1 face each other. In other words, the large diameter end 1*y* and small diameter end 1*x* of the tapered portion 1*b* are bent in directions opposite each other so as to form an approximately S shape.

When the small diameter tube portion 1*a* is forced into the original tube 1 by depressing the small diameter tube portion 1*a*, the large diameter end 1*y* of the tapered portion 1*b* is expanded radially outwardly. However, the deformation of the large diameter end 1*y* of the tapered portion 1*b* is restrained by the inner wall of the tube expanding bore 22, and the large diameter end 1*y* of the tapered portion 1*b* are not expanded outwardly beyond the inner wall of the tube expanding bore 22.

Figure 6:
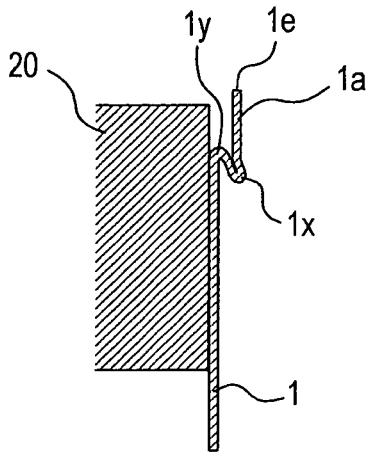
FIG. 6 is an explanatory view illustrating a comparative example.

Here, as illustrated in a comparative example of FIG. 6, in the case where the tube expanding bore 22 is not formed in the holding die 20, in response to pressing the small diameter tube portion 1*a* along the axial direction, a bent portion at the small diameter end 1*x* of the tapered portion 1*b* becomes not a U-shape but an appressed V shape. The bent portion is firmly fixed in the V shape and cannot be deformed easily. Even if the small diameter tube portion 1*a* is pressed further, it is not achieved that a portion from the small diameter end 1*x* to the tube end 1*e* enters further inside the original tube 1 while bending in series.

According to the first embodiment, as illustrated in FIG. 3A, the large diameter end 1*y* of the tapered portion 1*b* is bent into a U-shape to the inside of the original tube 1 (folded to the inside of the original tube 1). Further, the large diameter end 1*y* is pressed outwardly so that the outside of the large diameter end 1*y* comes in contact with the inner wall of the tube expanding bore 22. The small diameter end 1*x* is bent into a U-shape towards the outside of the original tube 1.

As the small diameter tube portion 1*a* is pressed further through the step portion 30, the small diameter tube portion 1*a* is gradually forced into the original tube 1 while the small diameter tube portion 1*a* becomes firmly in contact with the inner wall of the original tube 1. By pressing the small diameter tube portion 1*a* further to the inside of the original tube 1, the original tube 1 deforms with a portion bent into a U-shape at the small diameter end 1*x* moving in order. In the end, the bent portion deforms until becoming approximately flat, and the small diameter tube portion 1*a* and the small diameter end 1*x* are remolded into a cylindrical shape along the inner wall of the original tube 1.

The original tube 1 is deformed as described below at the same time of the above-described remolding of the small diameter tube portion 1*a* and the small diameter end 1*x*.

Figure 3B:
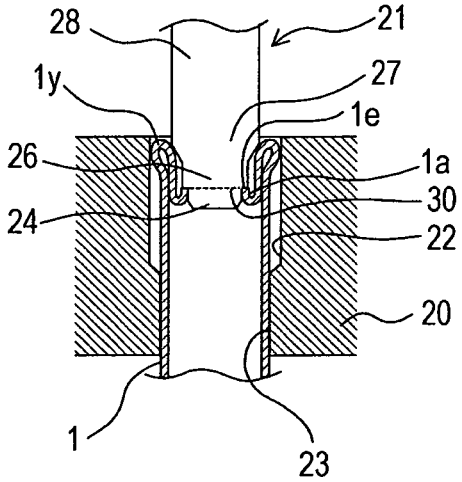

Specifically, as moving the punch member 21 along the axial direction, as illustrated in FIG. 3B, the straight portion 26 reaches the inside of the original tube 1. Sequentially, the tube expanding portion 28 reaches the inside of the original tube 1. Here, the tube expanding portion 28 impacts a bent portion at the large diameter end 1*y* and expands the portion outwardly. As moving the punch member 21 further, the extending portion 28 presses and expands in order and radially outwardly a portion of double-layered structure having the small diameter tube portion 1*a* in contact with or adjacent to the inner wall of the original tube 1 while pushing the portion of double-layered structure against the inner wall of the tube expanding bore 22.

Here, if the original tube 1 is expanded outwardly by a punch member 21 that includes the step portion 30 and the tube expanding portion 28 only and does not include the straight portion 26 and the tapered portion 27, cracks may be sometimes generated at the large diameter end 1*y* (i.e., the portion bent into a U-shape). In contrast, according to the first embodiment, the straight portion 26 and the tapered portion 27 are provided and there is a distance defined between the step portion 30 and the tube expanding portion 28, thereby enabling to inhibit generation of cracks.

Figure 4:
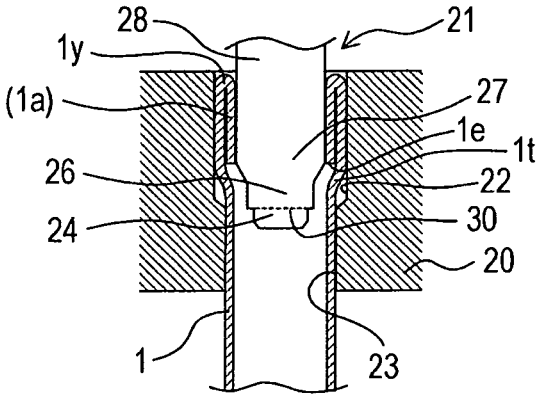
FIG. 4 is an explanatory view illustrating an end state of the tube expanding step according to the first embodiment of the present invention.

As moving the punch member 21 further, as illustrated in FIG. 4, the small diameter tube portion 1*a* is all folded back, and furthermore, the entire portion of the double-layered structure is expanded radially outwardly. In this case, the original tube 1 is deformed in the manner of being pressed against the inner wall of the tube expanding bore 22 of the holding die 20, and as a result, the outer wall of the original tube 1 comes into close contact with the inner wall of the tube expanding bore 22 and the precision of the outer diameter of the molded object is stabilized.

As described above, according to the first embodiment, the depth of the tube expanding bore 22 is greater than the axial length of the small diameter tube portion 1*a* and the tapered portion 1*b*, both molded in the tube shrinking step (i.e., the combined length of both). Therefore, with the post molded original tube 1, a length of the portion configuring the double-layered structure may become shorter than the portion radially expanded (e.g., see FIG. 4). Specifically, the tube end 1*e* does not reach a tapered portion 1*t* of the post molded original tube 1 and may terminate slightly short of the tapered portion 1*t*.

According to the first embodiment, the tapered portion 1*b* and the small diameter tube portion 1*a* are formed in the tube shrinking step. This molding is achieved easily by inserting the original tube 1 into the tube shrinking die 2.

Further, in the tube expanding step, the double-layered structure is formed by folding back the small diameter tube portion 1*a*, and the double-layered structure is pressed outwardly (tube expansion). In this step, pressing the punch member 21 inside suffices; that is, folding back and tube-expanding are both achieved in this single step. Accordingly, it is possible to inhibit an increase in the number of steps. Still further, because the punch member 21 is provided with the straight portion 26, it is possible to inhibit generation of cracks upon molding.

In addition, because the positioning portion 24 is provided at a tip end of the punch member 21, the original tube 1 and the punch member 21 are positioned easily (determination of the relative positions of the original tube 1 and the punch member 21). Further, because the punch member 21 is provided with the step portion 30, the original tube 1 is molded by the step portion 30 pressing the tube end 1*e* of the original tube 1 while the original tube 1 and the punch member 21 are positioned (without changing the relative positions).

Figure 5:
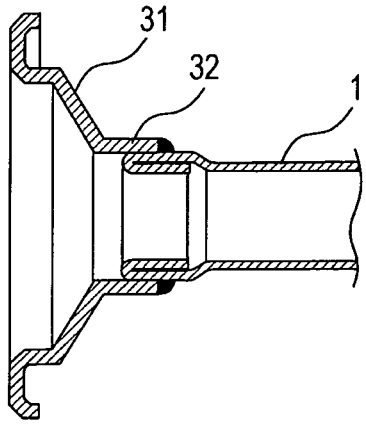
FIG. 5 is a cross-sectional view illustrating a usage example of a tube formed by a tube end molding method according to the first embodiment of the present invention.

The original tube 1 molded to possess the portion of double-layered structure as described above is inserted into a cylindrical portion 32 of a flange 31, and the cylindrical portion 32 and the double tubular original tube 1 are fillet welded to each other, as illustrated in FIG. 5. Even with the cylindrical portion 32 being thick and the original tube 1 being thin, welding at the portion of the double-layered structure of the original tube 1, even by MIG welding, may inhibit the welded portion of the original tube 1 (portion of double-layered structure) from melting and coming off, thereby facilitating welding.

The portion of double-layered structure of the original tube 1 is expanded radially, and thus the inner diameter of the portion of double-layered structure is expanded radially. In other words, reduction in the inner diameter resulting from forming the double-layered structure is prevented by expanding radially the entire portion of double-layered structure, and the inner diameter of the original tube 1 thus becomes approximately the same all over. Therefore, it may be possible to inhibit an increase in passage resistance inside the original tube 1. Accordingly, for example, when the original tube 1 is applied as an exhaust tube and so on, it may be possible to prevent exhaust performance from deteriorating.

Second Embodiment

Described next is the second embodiment with reference to FIGS. 7A to 7C, focusing on the differences from the first embodiment.

Figure 7A:
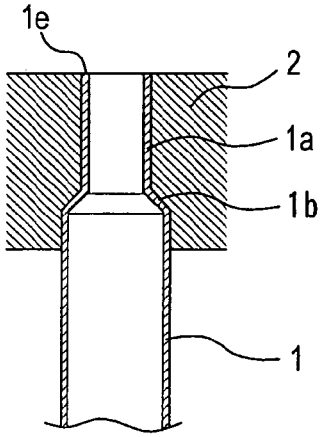
FIGS. 7A to 7C are explanatory views illustrating a tube end molding method according to a second embodiment.
Figure 7B:
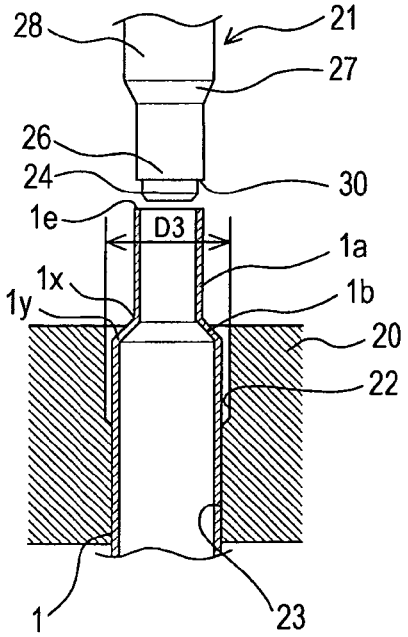
Figure 7C:
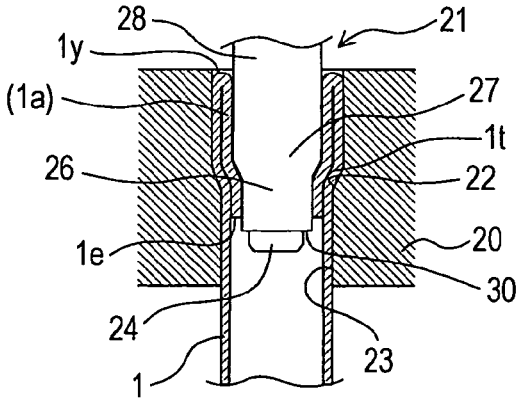

According to the second embodiment, a tube shrinking step is conducted so that a small diameter tube portion 1*a* becomes longer than the small diameter tube portion 1*a* of the first embodiment, as illustrated in FIG. 7A. This is achieved by driving the original tube 1 more deeply into the tube shrinking bore 4 (more deeply compared to the first embodiment).

Specifically, the small diameter tube portion 1*a* is formed so that the axial length of the small diameter tube portion 1*a* and a tapered portion 1*b* (i.e., the combined length of both) becomes equal to or greater than the depth of the tube expanding bore 22.

Sequentially, in a radial expansion step, a punch member 21 is employed, which is provided with a straight portion 26 longer than the straight portion 26 of the first embodiment.

According to the second embodiment, the small diameter tube portion 1*a* is formed so that the axial length of the small diameter tube portion 1*a* and the tapered portion 1*b* (i.e., the combined length of both) becomes equal to or greater than the depth of the tube expanding bore 22. As a result, when the small diameter tube portion 1*a* is folded back into the inside of the original tube 1, a portion of the double-layered structure is formed as described below. Specifically, with a post-molded original tube 1, at least a tapered portion 1*t* may be included in the double-layered structure (see FIG. 7C). More specifically, the tube end 1*e* terminates beyond the tapered portion 1*t*, and the portion of the double-layered structure is formed extending to the main body of the original tube 1 beyond the tapered portion 1*t*.

The longer the axial length of the small diameter tube portion 1*a* and the tapered portion 1*t* is, an area formed into the double-layered structure of the original tube 1 may become large. Accordingly, the length of the small diameter tube portion 1*a* may be adjusted so that the area of double-layered structure is designed as desired. In other words, in the tube shrinking step, a driving amount of the original tube 1 relative to the tube shrinking bore 4 may be adjusted.

According to the second embodiment, because at least the tapered portion 1*t* is included in the double-layered structure, it is possible to enhance the strength of the tapered portion 1*t*, thereby enabling inhibition of breakages and so on of the tapered portion t1.

Third Embodiment

Figure 8:
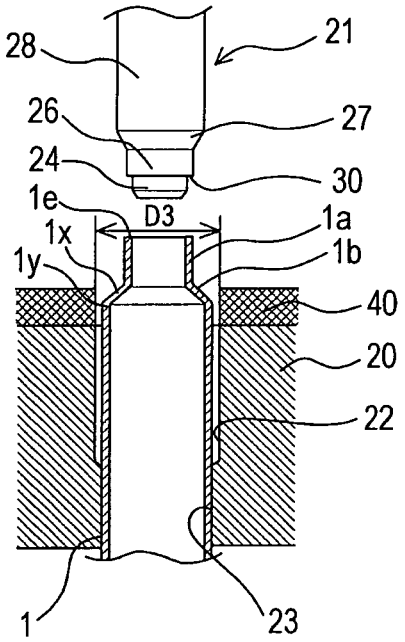
FIG. 8 is an explanatory view illustrating a tube expanding step of a tube end molding method according to a third embodiment.

Described next is a third embodiment of the present invention with reference to FIG. 8, focusing on the differences from the first embodiment.

According to the first embodiment, an example has been described, in which, in the tube expanding step, the original tube 1 is held in the original tube bore 23 of the holding die 20 so that a part or entire of the tapered portion 1*b* is housed in the tube expanding bore 22 (preferably, so that the tapered portion 1*b* does not stick out of the tube expanding bore 22). This is so that the function of pressing and expanding the original tube 1 is restricted by the inner wall of the tube expanding bore 22.

According to the third embodiment, the original tube 1 is held in the original tube bore 23 so that the tapered portion 1*b* sticks out of the tube expanding bore 22. Meantime, a restricting member 40 is additionally provided to restrict the function of the tube expanding portion 28 to press and expand the original tube 1 radially outwardly.

That is, a tube expanding step includes a step of preparing the restricting member 40. The restricting member 40 is arranged on an upper surface of the holding die 20. The inner diameter of the restricting member 40 is formed to be approximately the same as the inner diameter of the tube expanding bore 22.

By preparing such restricting member 40, the function of the tube expanding portion 28 to press and expand the original tube 1 radially outwardly is restricted by the restricting member 40 (specifically, by the inner wall of the restricting member 40). Accordingly, a similar effect is exhibited as in the first embodiment in which a part or the entirety of the tapered portion 1*b* (preferably, the entirety) is housed in the tube expanding bore 22, and molding of the original tube 1 is achieved.

The present invention should not be construed as limited to the embodiments set forth above and can be achieved by any modes within the scope of the present invention.

For example, according to the above embodiments, the thickness t of the original tube 1 should not be limited to 0.8 mm but may be 1.2 mm, 1.5 mm or the like.

According to the above embodiments, the tapered portion 27 may be formed into a curved shape as long as the tapered portion 27 may smoothly connect the straight portion 26 and the tube expanding portion 28.

Further, according to the second embodiment, the example has been described, in which the punch member 21 has the straight portion 26 longer than the straight portion 26 of the first embodiment. However, depending on circumstances, the same punch member 21 as the punch member 21 of the first embodiment may be employed.

Further, according to the third embodiment, the inner diameter of the restricting member 40 is formed to be approximately the same as the inner diameter of the tube expanding bore 22. However, depending on the circumstances, the inner diameter of the restricting member 40 may be different from the inner diameter of the tube expanding bore 22. Specifically, the inner diameter of the restricting member 40 may be smaller or greater than the inner diameter of the tube expanding bore 22.

The invention claimed is:

1. A tube end molding method comprising:

a tube shrinking step for molding one end of an original tube, in which a tapered portion having a diameter decreasing toward a tube end and a small diameter tube portion continuing from a small diameter side of the tapered portion to the tube end and having a diameter substantially the same as a diameter of the small diameter side are formed at the one end of the original tube;

a preparing step for preparing a holding die including: an original tube bore that holds the original tube; and an tube expanding bore formed to continue along the original tube bore and the tapered portion having an inner diameter greater by a predetermined value than an outer diameter of the original tube; and a tube expanding step including:

a first step for mounting the original tube into the original tube bore so that at least a part of the tapered portion is housed in the tube expanding bore;

a second step for folding the small diameter tube portion inside the original tube beginning at the tapered portion by depressing the small diameter tube portion in an axial direction with a punch member; and a third step for moving the punch member further in the axial direction after folding the small diameter tube portion, inserting a tapered portion and a tube expanding portion of the punch member into an inside of a folded portion of the original tube, and pressing the folded portion against an inner wall of the tube expanding bore.

2. The tube end molding method according to claim 1, wherein a positioning portion is formed at a tip end of the punch member and is insertable into the small diameter tube portion, and wherein the second step includes a step for positioning the punch member and the small diameter tube portion by inserting the positioning portion into the small diameter tube portion.

3. The tube end molding method according to claim 2, wherein the punch member includes a step portion between the positioning portion and the tube expanding portion, and wherein the second step includes a step for depressing the small diameter tube portion in the axial direction by impacting the step portion on the tube end of the small diameter tube portion.

4. The tube end molding method according to claim 3, wherein the punch member includes a straight portion having a diameter smaller than the tube expanding portion between the step portion and the tube expanding portion.

5. The tube end molding method according to claim 4, wherein an outer diameter of the straight portion is approximately the same as an outer diameter of the small diameter tube portion.

* * * * *